US005214985A

United States Patent [19]

Rinehart, deceased

[11] Patent Number: 5,214,985

[45] Date of Patent: Jun. 1, 1993

[54] OIL DRAIN PLUG WRENCH ADAPTER

[75] Inventor: William H. Rinehart, deceased, late of Dunnellon, Fla., by Lucille G. Rinehart, administrator

[73] Assignee: Lucille G. Rinehart, Dunnellon, Fla.; as Trustee of a Living Revocable Trust

[21] Appl. No.: 864,663

[22] Filed: Apr. 7, 1992

[51] Int. Cl.[5] ..... B25B 13/06

[52] U.S. Cl. ..... 81/176.15; 81/180.1

[58] Field of Search ..... 81/176.1, 176.15, 176.2, 81/180.1, 184, 185.2

[56] References Cited

U.S. PATENT DOCUMENTS

| | | | |
|---|---|---|---|
| 4,145,939 | 3/1979 | Garrison | 81/125 |
| 4,171,653 | 10/1979 | Holloway, Jr. | 81/180.1 |
| 4,227,429 | 10/1980 | Bowers, Jr. et al. | 81/176.15 |
| 4,252,037 | 2/1981 | Raine | 81/124.3 |
| 4,351,075 | 9/1982 | Pittard, Jr. | 7/138 |
| 4,357,845 | 11/1982 | Cornia | 81/125 |
| 4,794,827 | 1/1989 | Poling | 81/125 |
| 4,819,521 | 4/1989 | Lang | 81/177.1 X |

*Primary Examiner*—D. S. Meislin
*Attorney, Agent, or Firm*—Paul S. Rooy

[57] ABSTRACT

An oil drain plug wrench adapter is disclosed comprising a disk having a disk upper surface and a disk lower surface, a square aperture sized to fit a standard socket wrench male drive extending through said disk and centrally located on said disk, and a pair of post holders extending perpendicularly from said disk lower surface, said post holders having post holder bores spaced apart relative to each other and sized so as to allow the posts of a standard two post oil drain plug to fit into them. In operation, a socket wrench male drive is inserted into the square aperture, the posts are inserted into the post holder bores and the oil drain plug is turned using the socket wrench. If necessary, an extender having an extender female end and an extender male end may be interposed between the socket wrench and the oil drain plug wrench adapter by inserting the socket wrench male drive into the extender female end and the extender male end into the square aperture.

7 Claims, 2 Drawing Sheets

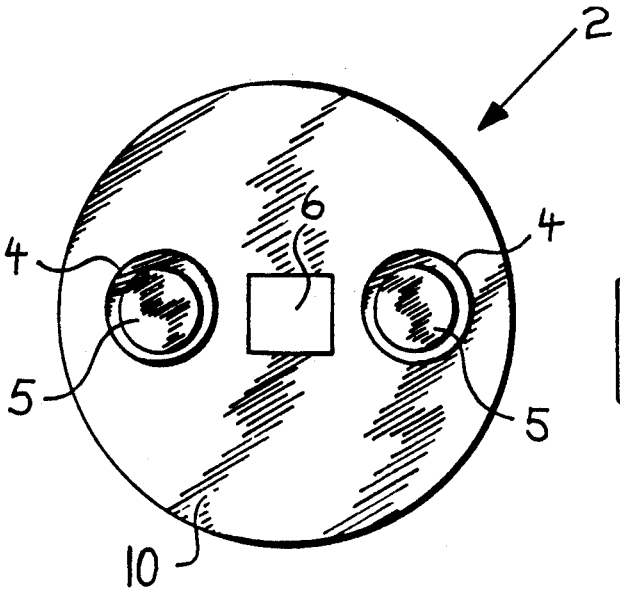
FIG 3
FIG 4
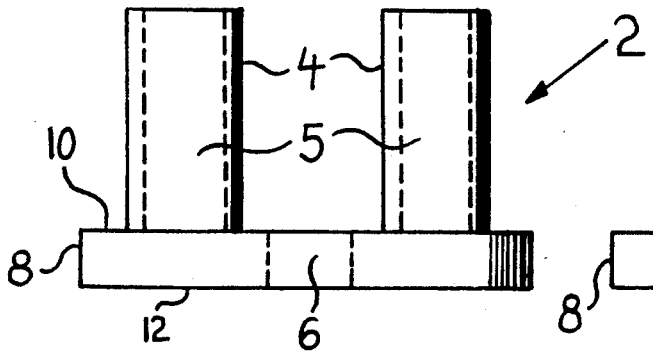
FIG 5
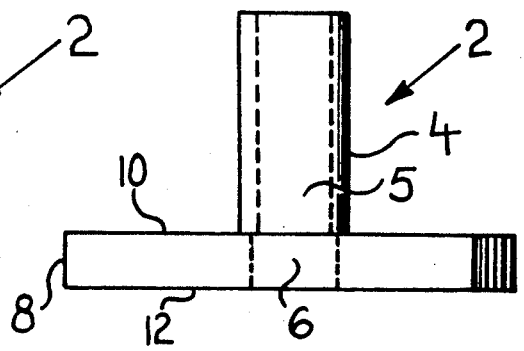

OIL DRAIN PLUG WRENCH ADAPTER

CROSS REFERENCE TO RELATED

| | | |
|---|---|---|
| 4,794,827 | Poling | Drain Plug Removing Device |
| 4,357,845 | Cornia | Apparatus for Manipulating Wing-nuts |
| 4,351,075 | Pittard, Jr. | Combination Oil Plug Wrench and Integral Oil Filler |
| 4,252,037 | Raine | Plug Wrench |
| 4,227,429 | Bowers, Jr. et al. | Spanner Socket Wrench |
| 4,145,939 | Garrison | Drain Plug Holder |

STATEMENT AS TO RIGHTS TO INVENTIONS MADE UNDER FEDERALLY SPONSORED RESEARCH AND DEVELOPMENT

No such rights exist.

BACKGROUND OF THE INVENTION

1. Field of the Invention

The instant invention relates to wrench adapters and in particular to an oil drain plug wrench adapter which allows a standard socket wrench to be used to remove and replace a two post oil drain plug.

2. Background of the Invention

Many small internal combustion engines such as those used to power lawnmowers, chainsaws, etc., use an oil drain plug design which incorporates a pair of upstanding posts. In order to drain the oil in these engines the mechanic must firmly grasp the pair of upstanding posts with his fingers and turn the oil drain plug counterclockwise to thread the oil drain plug out of the engine.

The oil drain plug is frequently stuck in place and encrusted with oil and dirt, making it difficult to turn. In addition, the oil drain plug is often recessed, exacerbating the problem of its removal. If the engine in question is hot a burn hazard exists. Finally, if the mechanic is of advanced years and possibly suffering from arthritis (as is common among older people), it may be impossible to remove the oil drain plug at all, thereby rendering an oil change impossible. Given that regular oil changes are necessary to achieve maximum engine life, the inability to remove the oil drain plug may lead to premature engine failure.

3. Description of the Prior Art

U.S. Pat. No. 4,794,827 was granted Poling for a Drain Plug Removing Device. This Device is shaped roughly like a thumbscrew and fits over the hexagonal head of an oil drain plug having a hexagonal head. Poling's invention would be unusable on a two post oil drain plug because is is not shaped to grasp a two post oil drain plug. Also, as can be observed in FIGS. 1 and 2, this Device only marginally increases the leverage available to remove a stuck oil drain plug.

Cornia teaches an Apparatus for Manipulating Wing-nuts in U.S. Pat. No. 4,357,845. While a standard ratchet socket wrench may be used to turn the apparatus, the use of an appropriately sized socket is required to attach the socket wrench to the Apparatus. In addition, the Apparatus is not shaped to accept a two post oil drain plug, rendering it useless in the removal of two post oil drain plugs.

U.S. Pat. Nos. 4,351,075 and 4,252,037 both teach wrenches capable of engaging the upstanding posts of a two post oil drain plug and rotating same. Neither of these inventions will work if the oil drain plug posts are recessed under the surface of the engine (as occurs fairly frequently). Both these inventions require the purchase of an entire wrench; neither provides an inexpensive adapter that could be used with an existing socket wrench.

Bowers, Jr. et al. describes a Spanner Socket Wrench in U.S. Pat. No. 4,227,429. While this Socket may be used with an existing socket wrench, it is shaped incorrectly to grasp the posts of a two post oil drain plug.

U.S. Pat No. 4,145,939 was issued Garrison for a Drain Plug Holder. This Holder is sized to hold an oil drain plug having a hexagonal head, and does not provide for any means of exerting substantial turning force on the oil drain plug.

SUMMARY OF THE INVENTION

Accordingly, it is an object of this invention to provide an oil drain plug wrench adapter which will firmly grasp the upstanding posts of a two post oil drain plug.

It is another object of this invention to provide an oil drain plug wrench adapter whose use will help avoid the hazard of the mechanic being burned by a hot engine.

It is still another object of this invention to provide an oil drain plug wrench adapter which may be used to remove and replace two post oil drain plugs which are recessed.

It is another object of this invention to provide an oil drain plug wrench adapter which may be used in combination with an existing socket wrench.

It is still another object of this invention to provide an oil drain plug wrench adapter which is inexpensive to manufacture, thereby rendering it readily affordable to the consumer.

It is another object of this invention to provide an oil drain plug wrench adapter which is easy to use.

BRIEF DESCRIPTION OF THE DRAWINGS

The invention, together with the other objects, features, aspects and advantages thereof will be more clearly understood from the following in conjunction with the accompanying drawings.

Two sheets of drawings are provided. Sheet one contains FIGS. 1 and 2. Sheet two contains FIGS. 3, 4 and 5.

FIG. 3 is a bottom vie of the oil drain plug wrench adapter.

FIG. 4 is a front view of the oil drain plug wrench adapter.

FIG. 5 is a side view of the oil drain plug wrench adapter.

DETAILED DESCRIPTION OF THE PREFERRED EMBODIMENT

Figures 1, 2:
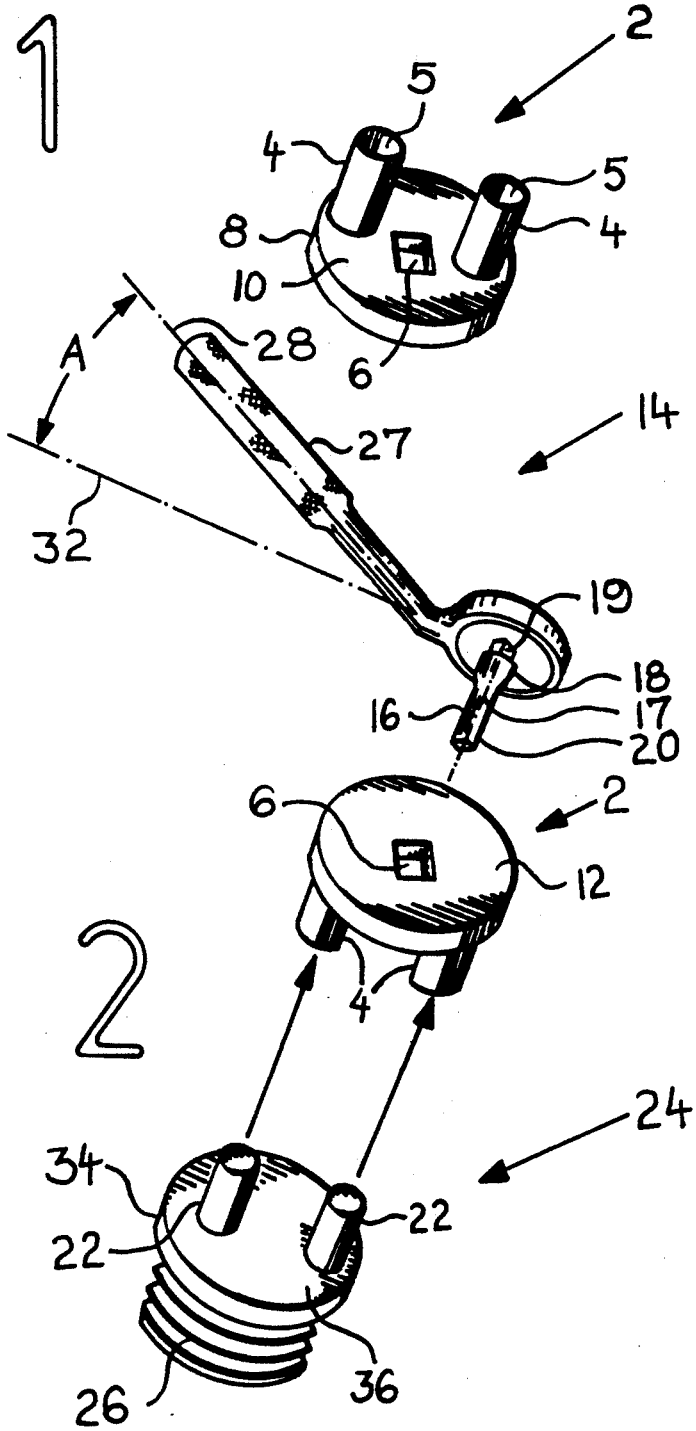
FIG. 1 is a bottom isometric view of the oil drain plug wrench adapter.
FIG. 2 is a top isometric view of the oil drain plug wrench adapter, a socket wrench and an oil drain plug.

Referring now to FIG. 1 we can observe a bottom isometric view of an oil drain plug wrench adapter 2. The oil drain plug wrench adapter 2 is comprised of a disk 8 having a disk lower surface 10, a disk upper surface 12, and a centrally disposed square aperture 6, and two post holders 4 projecting perpendicularly from disk lower surface 10.

Each of said post holders 4 has a post holder bore 5 extending perpendicularly from said disk lower surface 10. The said post holder bores 5 are spaced apart relative to each other and sized so as to allow the posts 22 (see FIG. 2) to fit into them.

In the preferred embodiment post holders 4 are cylindrical.

FIG. 2 depicts how socket wrench 14 engages oil drain plug wrench adapter 2, which in turn engages oil drain plug 24.

Socket wrench 14 has socket wrench handle 27 having handle axis 28, socket wrench axis 32, and socket wrench male drive 19. Optional extender 16 has extender female end 18 sized to fit over socket wrench male drive 19, extender male end 20 whose cross sectional dimensions are the same as the cross sectional dimensions of socket wrench male drive 19, and extender axis 17.

FIG. 2 item 30 is the angle A formed by handle axis 28 and socket wrench axis 32. Handle axis 28, socket wrench axis 32 and extender axis 17 are coplaner. In the preferred embodiment angle A is approximately 25°.

Square aperture 6 is sized to admit extender male end 20 such that when extender 16 rotates, so does oil drain plug wrench adapter 2.

FIG. 2 item 24 is a typical oil drain plug comprising an oil drain plug male thread 26, an oil drain plug disk 34 having an oil drain plug disk upper surface 36 on the side of said oil drain plug disk 34 opposite said oil drain plug male thread 26, and two cylindrical posts 24 perpendicular to said oil drain plug disk upper surface 36.

Post holder bores 5 are sized to fit over said posts 22 such that when oil drain plug wrench adapter 2 is rotated, so also is oil drain plug 24.

FIG. 3 is a bottom view of oil drain plug wrench adapter 2. Square aperture 6 is visible, as is disk lower surface 10 from which post holders 4 having post holder bores 5 project.

FIG. 4 is a front view of the oil drain plug wrench adapter 2. We can observe disk 8 having disk lower surface 10 and disk upper surface 12. Post holders 4 having post holder bores 5 project perpendicularly from disk lower surface 10.

FIG. 5 is a side view of the oil drain plug wrench adapter 2. We can observe disk 8 having disk lower surface 10 and disk upper surface 12. Post holder 4 having post holder bore 5 projects perpendicularly from disk lower surface 10.

Operation

Referring to FIG. 2, socket wrench male drive 19 is inserted in square aperture 6. Post holder bores 5 are placed over posts 22, and socket wrench 14 is used in the conventional fashion to turn oil drain plug 24.

If the recessed position of oil drain plug 24 dictates, an extender 16 of appropriate length may be interposed between socket wrench 14 and oil drain plug wrench adapter 2 by inserting extender male end 20 into square aperture 6, and inserting socket wrench male drive 19 into extender female end 18.

Angle A (FIG. 2 item 30) further increases the clearance between socket wrench handle 27 and the engine from which oil drain plug 24 is being removed, thus aiding the removal and installation of oil drain plug 24.

While a preferred embodiment of the invention has been illustrated herein, it is to be understood that changes and variations may be made by those skilled in the art without departing from the spirit and scope of the appending claims.

I claim:

1. An oil drain plug wrench adapter comprising:

a disk having a disk upper surface and a disk lower surface, a square aperture sized to fit a standard socket wrench male drive extending through said disk and centrally located in said disk, and a pair of post holders extending perpendicularly from the disk lower surface, each of said post holders having a post holder bore extending perpendicularly from said disk lower surface, said post holder bores being spaced apart relative to each other and sized so as to allow the posts of a standard oil drain plug to fit into them, said post holders and post holder bores abutting a solid portion of said disk thus defining blind bores.

2. The oil drain plug wrench adapter of claim 1 wherein said post holders are cylindrically shaped.

3. In combination the oil drain plug wrench adapter of claim 2 and a socket wrench having a socket wrench male drive inserted into said square aperture.

4. The oil drain plug wrench adapter of claim 3 further comprising an extender having an extender female end and an extender male end, said extender being interposed between said socket wrench and said oil drain plug wrench adapter by inserting said socket wrench male drive into said extender female end, and by inserting said extender male end into said square aperture.

5. The oil drain plug wrench adapter of claim 3 wherein said socket wrench has a socket wrench axis and a handle axis, and the angle between said socket wrench axis and said handle axis is approximately 25 degrees.

6. The oil drain plug wrench adapter of claim 4 further comprising a standard oil drain plug having two upstanding posts, said posts being inserted into the said post holder bores.

7. The oil drain plug wrench adapter of claim 2 wherein said square aperture is sized to fit a standard $\frac{1}{4}$ inch socket wrench male drive.

* * * * *